US010240494B2

(12) United States Patent
Nakano et al.

(10) Patent No.: US 10,240,494 B2
(45) Date of Patent: Mar. 26, 2019

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventors: Kaita Nakano, Atsugi (JP); Hiroyuki Kato, Novi, MI (US); Kenji Ariga, Fujisawa (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/575,239

(22) PCT Filed: May 6, 2016

(86) PCT No.: PCT/JP2016/063642
§ 371 (c)(1),
(2) Date: Nov. 17, 2017

(87) PCT Pub. No.: WO2016/185918
PCT Pub. Date: Nov. 24, 2016

(65) Prior Publication Data

US 2018/0135470 A1 May 17, 2018

(30) Foreign Application Priority Data

May 20, 2015 (JP) ..... 2015-102336

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/3443* (2013.01);
(Continued)

(58) Field of Classification Search
CPC ..... F01L 1/047; F01L 1/3442; F01L 2001/34456; F01L 2001/34466;
(Continued)

(56) References Cited

U.S. PATENT DOCUMENTS 8,689,748 B2 4/2014 Watanabe
2011/0162601 A1* 7/2011 Fujiyoshi ..... F01L 1/3442 123/90.15

(Continued)

FOREIGN PATENT DOCUMENTS

JP 2011-202563 A 10/2011
JP 2013-087643 A 5/2013
WO WO-2011/001702 A1 1/2011

*Primary Examiner* — Zelalem Eshete
(74) *Attorney, Agent, or Firm* — Foley & Lardner LLP

(57) ABSTRACT

Lock pin (71) is disposed movably in axial direction in accommodation hole (70) formed at vane rotor (12). Top end portion of lock pin (71) is fitted into lock hole (23) provided at housing (11), then relative rotation position of vane rotor (12) is restrained at predetermined lock position. Vane rotor (12) is provided with small diameter portion (84) and large diameter portion (85) which are formed alternately in circumferential direction. Large diameter portion (85) extends in circumferential direction so as to cover lock hole (23). First vane (36A) protrudes from outer periphery of large diameter portion (85) to radially outer side. At least a part of lock pin (71) and at least a part of accommodation hole (70) overlap with large diameter portion (85), and are located at position that overlaps with area (86) formed by elongating first vane (36A) to radially inner side.

13 Claims, 8 Drawing Sheets

(52) U.S. Cl.
CPC ..... *F01L 2001/34423* (2013.01); *F01L 2001/34456* (2013.01); *F01L 2001/34463* (2013.01); *F01L 2001/34466* (2013.01); *F01L 2001/34469* (2013.01); *F01L 2001/34476* (2013.01)

(58) Field of Classification Search
CPC ... F01L 2001/34469; F01L 2001/34423; F01L 2001/3443; F01L 2001/34463; F01L 2001/34476
USPC ..... 123/90.17
See application file for complete search history.

(56) References Cited

U.S. PATENT DOCUMENTS

| | | | |
|---|---|---|---|
| 2012/0000437 | A1 | 1/2012 | Ozawa et al. |
| 2013/0092112 | A1 | 4/2013 | Watanabe |

* cited by examiner

MOST-RETARDED ANGLE POSITION

MIDDLE LOCK POSITION

MOST-ADVANCED ANGLE POSITION

VALVE TIMING CONTROL DEVICE FOR INTERNAL COMBUSTION ENGINE

TECHNICAL FIELD

The present invention relates to a valve timing control device for controlling a valve timing of an intake valve and an exhaust valve (hereinafter, called an engine valve) of an internal combustion engine.

BACKGROUND ART

A variety of valve timing control devices of the internal combustion engine have been proposed, and as one of the valve timing control devices, Patent Document 1 discloses a vane type valve timing control device. In this device, as is known, a vane rotor is rotatably disposed at a radially inner side of a cylindrical housing. The vane rotor is provided with vanes that extend in a radially outer direction from an outer circumference of a rotor core and partition off a working chamber formed between adjacent two shoes in the housing into a retard working chamber and an advance working chamber. The device is configured so that, by controlling hydraulic pressures of these retard and advance working chambers, a rotation position of the vane rotor relative to the housing is changed, and the valve timing of the engine valve is controlled.

The vane rotor is provided with a small diameter portion and a large diameter portion whose radial direction size is larger than that of the small diameter portion, which are arranged alternately in a circumferential direction of the vane rotor. Then, an accommodation hole that accommodates therein a lock member movably in an axial direction is formed at the large diameter portion of the vane rotor which is thicker in the radial direction. A tip end portion of this lock member is fitted in a lock hole formed on an axial direction side surface of the housing, and then, the rotation position of the vane rotor relative to the housing is restrained at a predetermined lock position.

CITATION LIST

Patent Document

Patent Document 1: Japanese Unexamined Patent Application Publication No. JP2013-087643

SUMMARY OF THE INVENTION

Technical Problem

In such a configuration in which the lock member is provided at the large diameter portion, however, in order to ensure the rigidity of the large diameter portion around the accommodation hole accommodating the lock member, there is a need to secure a measure of thickness (a radial direction size) between the accommodation hole and an outer periphery of the large diameter portion. The radial direction size of the large diameter portion therefore tends to increase.

An object of the present invention is therefore to provide a new valve timing control device of the internal combustion engine which is capable of suppressing the increase in the radial direction size of the large diameter portion and reducing the radial direction size of the large diameter portion even though the lock member is formed at the large diameter portion.

Solution to Problem

In the present invention, a vane rotor is provided with a small diameter portion and a large diameter portion whose radial direction size is larger than that of the small diameter portion, and the small diameter portion and the large diameter portion are arranged alternately in a circumferential direction. The large diameter portion extends in the circumferential direction so as to cover a lock hole that is formed at an axial direction side surface of a housing all over a relatively rotatable range of the vane rotor with respect to the housing. A first vane protrudes from an outer periphery of the large diameter portion to a radially outer side.

At least a part of lock member overlaps with the large diameter portion, and an axis of the lock member is located at a position that overlaps with an area formed by elongating the first vane to a radially inner side, viewed from an axial direction of the vane rotor.

In this way, since the lock member is provided close to the large diameter portion at the radially inner side of the first vane, even if the lock member and its accommodation hole get closer to an outer peripheral side of the large diameter portion, a measure of thickness around the accommodation hole can be secured. Hence, it is possible to suppress a radial direction size of the large diameter portion while securing the thickness around the accommodation hole with the lock member and the accommodation hole located at as close a position as possible to an outer periphery of the large diameter portion.

Effects of Invention

According to the present invention, it is possible to suppress the increase in the radial direction size of the large diameter portion and reduce the radial direction size of the large diameter portion even though the lock member is formed at the large diameter portion.

EMBODIMENTS FOR CARRYING OUT THE INVENTION

Figure 1:
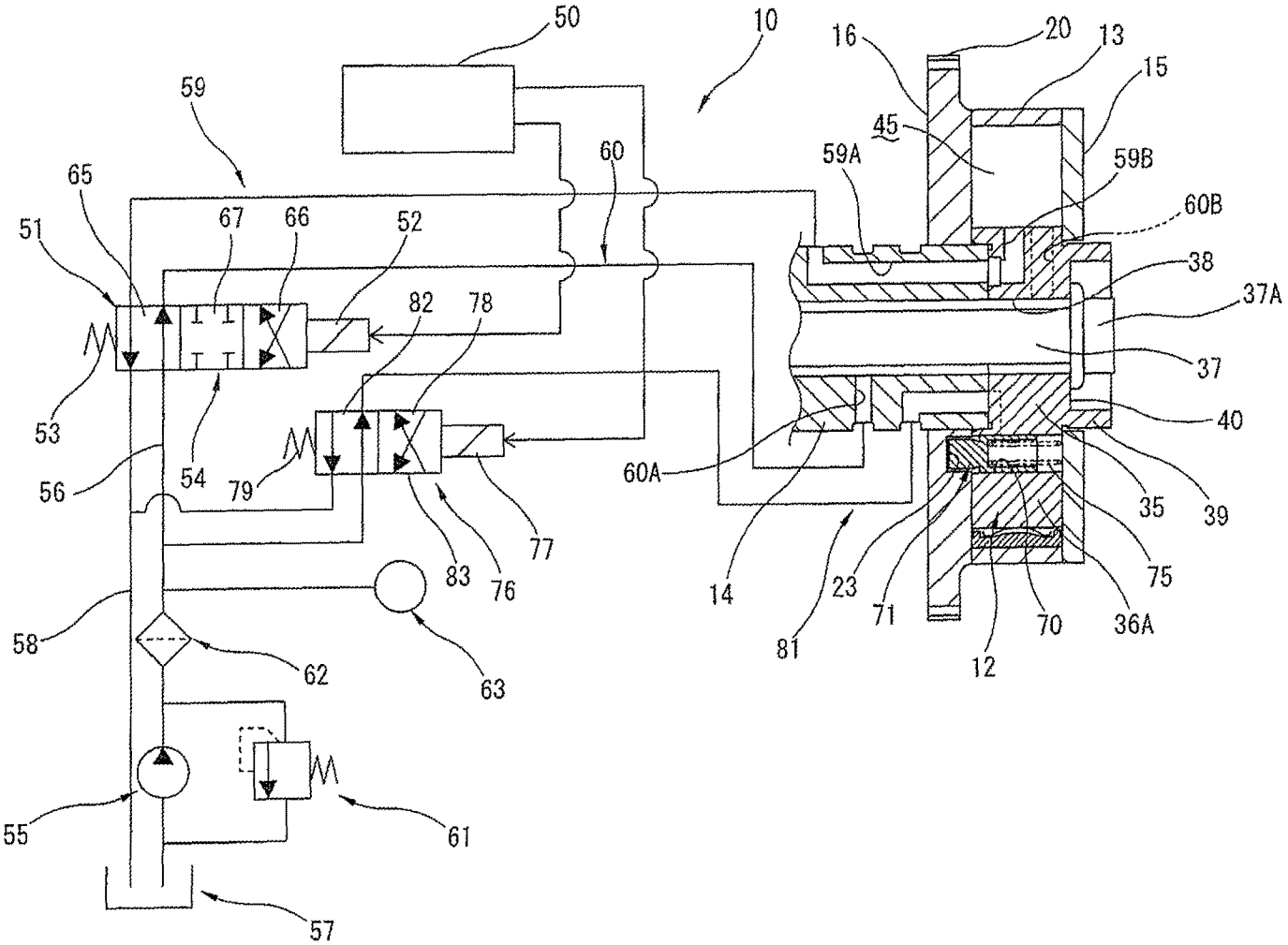
FIG. 1 is a general block diagram showing one embodiment of a valve timing control device of an internal combustion engine according to the present invention.

In the following description, the present invention will be explained according to an embodiment and drawings. FIGS.

1 to 8 show an embodiment in which a valve timing control device of the present invention is applied to an intake valve side of an internal combustion engine.

First, a basic structure of a valve timing control device 10 will explained. The valve timing control device 10 has a housing 11 that is a rotary member rotating with a crankshaft (not shown) and a vane rotor 12, as a rotary member rotating with a camshaft 14, which is disposed at a radially inner side of a housing body 13 as a cylindrical portion of the housing 11 and aligned coaxially with the housing body 13 so as to be able to rotate relative to the housing body 13 (the housing 11).

Figure 3:
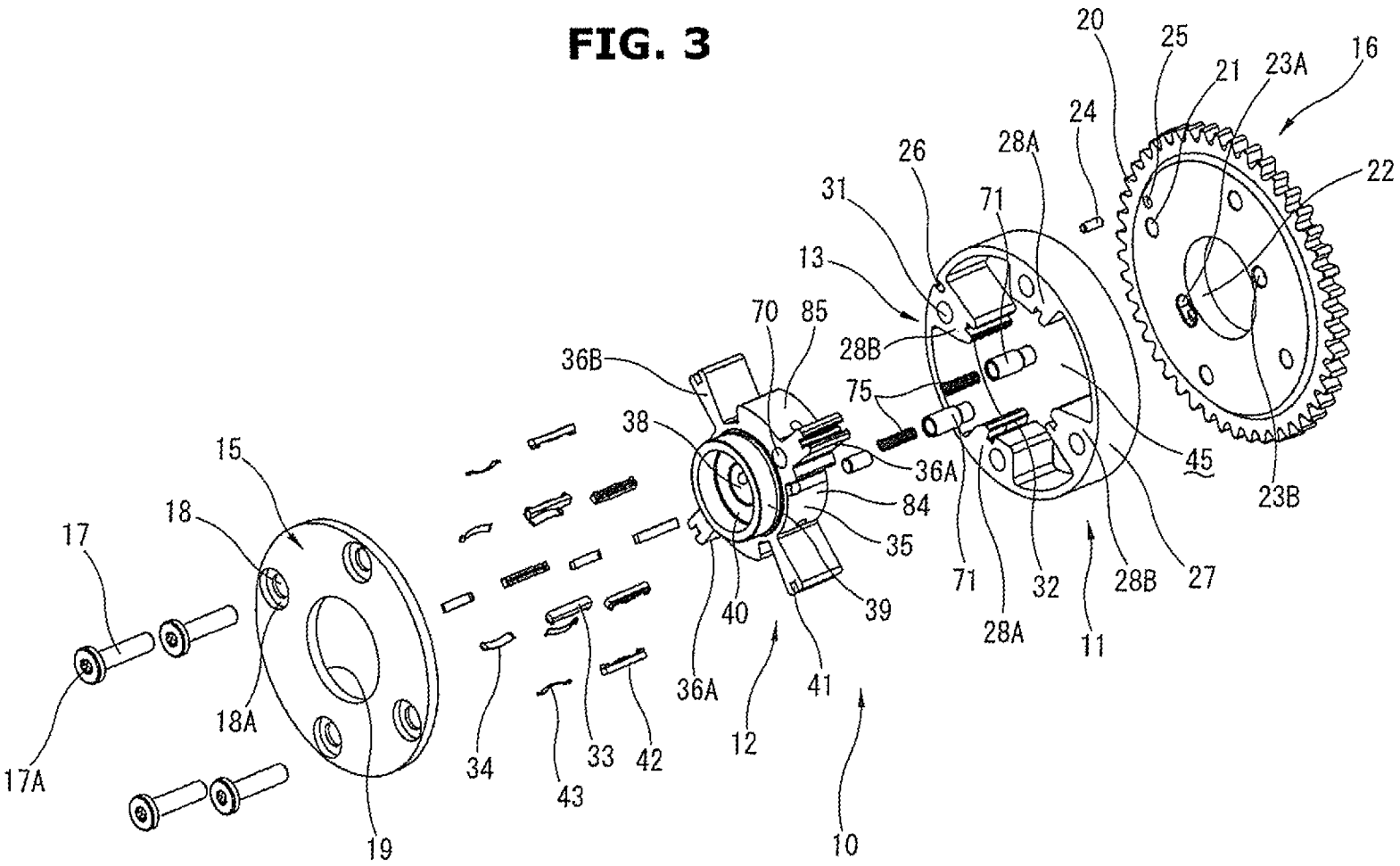
FIG. 3 is a perspective exploded view of the valve timing control device.
Figure 4:
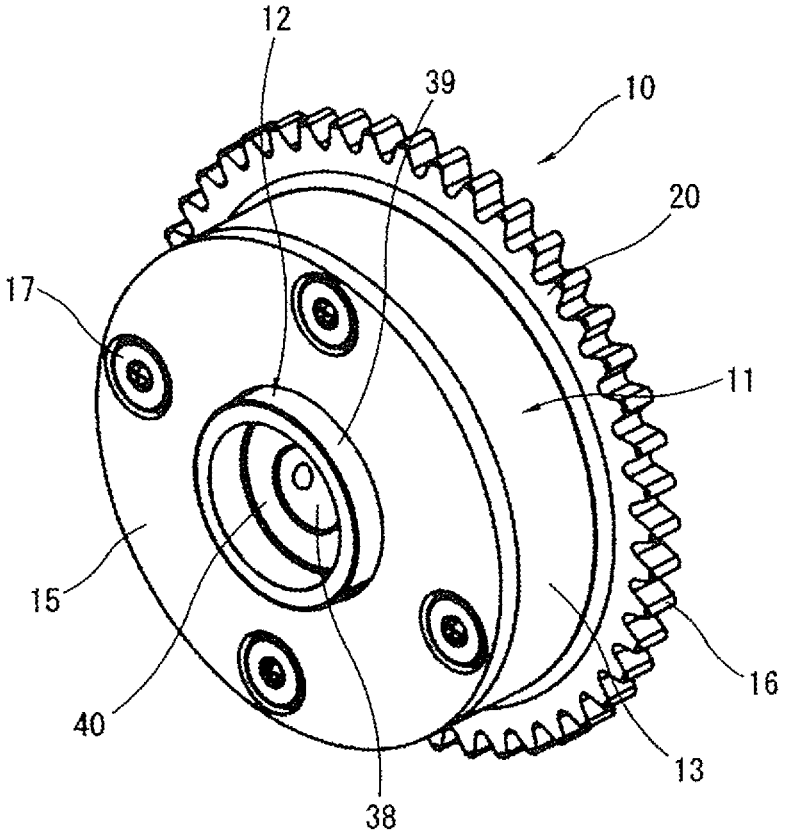
FIG. 4 is a perspective view of the valve timing control device.

The housing 11 is disposed at a front side of the camshaft 14 and aligned coaxially with the camshaft 14. Also as shown in FIG. 3, the housing 11 has the housing body 13 and first and second side portions that are arranged at axial direction both sides of the housing body 13 and close openings of the axial direction both sides of the housing body 13. In the present embodiment, the housing 11 has a front plate 15 that is one of the first and second side portions and a rear plate 16 that is the other of the first and second side portions. These housing body 13, front plate 15 and rear plate 16 are tightened together with four fixing bolts 17, and integrally rotate in an axial direction.

The front plate 15 is a metal-made thin disk plate. Four first bolt holes 18 into which the fixing bolts 17 are inserted are formed at an outer circumferential portion of the front plate 15, and a first center hole 19 is formed at the middle of the front plate 15. Each of the first bolt holes 18 has at a circumference thereof a seating surface 18A on which a head portion 17A of the fixing bolt 17 is seated.

The rear plate 16 is a metal-made thin disk plate, and a sprocket 20 having at an outer circumference thereof a plurality of toothed wheels is formed integrally with the rear plate 16. The rear plate 16 is driven and rotates by the crankshaft through a timing chain (not shown) that is wound around the sprocket 20 and the crankshaft. Four female thread holes 21 into which a male screw of a tip end of the fixing bolt 17 is screwed are formed at an outer circumferential portion of the rear plate 16. Further, a second center hole 22 into which a front end portion of the camshaft 14 is rotatably inserted is formed at the middle of the rear plate 16 which is close to an axis of the rear plate 16. Two lock holes 23 (23A and 23B) are formed around the second center hole 22 at symmetrical positions that are opposite sides of the axis of the rear plate 16. The rear plate 16 is provided with a positioning pin hole 25 into which a positioning pin 24 is press-fitted and fixed. This positioning pin 24 is fitted into a positioning pin groove 26 that is recessed at an outer circumference of the housing body 13, thereby making positioning of the rear plate 16 to the housing body 13 at assembly.

The housing body 13 is a cylindrical single-piece body made of, for instance, sintered metal. Four shoes 28 (28A and 28B) are formed so as to protrude from an inner circumference of an outer circumferential cylindrical portion 27 to a radially inner side of the housing body 13. Each shoe 28 has a thickness shape having the same axial direction size as that of the outer circumferential cylindrical portion 27. Also, each shoe 28 has a tapering trapezoidal shape whose circumferential size is gradually reduced toward the radially inner side. A second bolt hole 31 into which the fixing bolt 17 is inserted is formed at each shoe 28. Each shoe 28 is configured such that a tip end of the shoe 28 faces an outer circumference of a rotor core 35 that forms a cylindrical shape of the vane rotor 12 through a slight gap, and a part of the tip end of the shoe 28 makes sliding contact with the outer circumference of the rotor core 35. More specifically, a first seal groove 32 is formed at the tip end of the shoe 28, and the first seal groove 32 accommodates therein an almost square bracket-shaped first seal member 33 that seals the gap between the shoe 28 and the rotor core 35 by making sliding contact with the outer circumference of the rotor core 35 and a first plate spring 34 that forces the first seal member 33 to the radially inner side toward the outer circumference of the rotor core 35.

The vane rotor 12 is a single-piece rotor made of, for instance, sintered metal. The vane rotor 12 has the cylindrical rotor core 35 located at the middle of the vane rotor 12 and four vanes 36 (36A and 36B) radially protruding to a radially outer side from the outer circumference of the rotor core 35. The vane rotor 12 is aligned coaxially with the hollow camshaft 14 at a front end of the camshaft 14, and these vane rotor 12 and hollow camshaft 14 are tightened together with a cam bolt 37 (see FIGS. 1 and 2), then the vane rotor 12 rotates integrally with the camshaft 14.

The rotor core 35 has a third center hole 38 which the cam bolt 37 penetrates, which is close to an axis of the rotor core 35. Further, the rotor core 35 is provided at a front end side thereof with a cylindrical portion 39 that accommodates therein a head portion 37A of the cam bolt 37. This cylindrical portion 39 penetrates the first center hole 19 of the front plate 15 so as to be able to rotate relatively. A bottom surface of the cylindrical portion 39 where one end of the third center hole 38 is open functions as a seating surface 40 on which the head portion 37A of the cam bolt 37 is seated.

Each of the four vanes 36 has a thin plate shape. The four vanes 36 are arranged at substantially regular intervals of 90 degrees in a circumferential direction. Radial direction lengths of the vanes 36 are set such that tip ends of the all vanes 36 are positioned on the same circumference. Each vane 36 is configured such that a tip end of the vane 36 faces an inner circumference of the housing body 13 through a slight gap, and a part of the tip end of the vane 36 makes sliding contact with the inner circumference of the housing body 13. More specifically, a second seal groove 41 is formed at the tip end of the vane 36, and the second seal groove 41 accommodates therein an almost square bracket-shaped second seal member 42 that seals the gap between the vane 36 and the housing body 13 by making sliding contact with the inner circumference of the housing body 13 and a second plate spring 43 that forces the second seal member 42 to the radially outer side toward the inner circumference of the housing body 13.

The vane 36 making sliding contact with the inner circumference of the housing body 13 in this manner liquid-tightly divides or partitions off a working chamber 45 (45A and 45B) that is a space formed between adjacent two shoes 28 of the housing body 13 into an advance working chamber 46 (46A and 46B) and a retard working chamber 47 (47A and 47B).

As shown in FIG. 1, a first electromagnetic switching valve 51 as a valve timing control unit controls a hydraulic pressure of working fluid that is filled in the advance working chamber 46 and the retard working chamber 47, thereby changing a rotation position of the vane rotor 12 relative to the housing 11 (a relative rotation position of the vane rotor 12 to the housing 11) and consequently controlling a valve timing of the intake valve driven by the camshaft 14.

The first electromagnetic switching valve 51 is a so-called three-position switching hydraulic pressure control valve. A first solenoid 52 changes a position of the first spool 54 by a duty signal from a control unit 50 against a spring force of a first return spring 53, thereby switching the hydraulic pressure. A hydraulic pressure supply passage 56 supplied with a working fluid that is pressurized by an oil pump 55, a drain passage 58 draining the working fluid to an oil pan 57 side, an advance oil passage 59 communicating with the advance working chamber 46 and a retard oil passage 60 communicating with the retard working chamber 47 are connected to the first electromagnetic switching valve 51.

Figure 8:
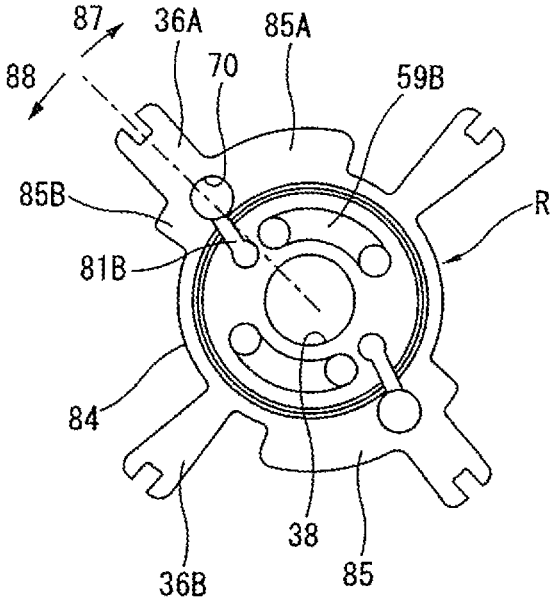
FIG. 8 is a back view of the vane rotor of the valve timing control device.

On the hydraulic pressure supply passage 56, besides the oil pump 55, a flow amount control valve 61 that controls (limits) a flow amount of the working fluid supplied to the hydraulic pressure supply passage 56 and a filter 62 that removes foreign material existing in the working fluid are provided. The hydraulic pressure supply passage 56 is connected to not only the first electromagnetic switching valve 51 but also a main gallery 63 of the internal combustion engine and after-mentioned second electromagnetic switching valve 76. The advance oil passage 59 includes a first advance oil passage 59A formed at the camshaft 14 and a second advance oil passage 59B formed at the vane rotor 12. As shown in FIG. 8, a part of the second advance oil passage 59B is recessed on an axial direction side surface of the vane rotor 12. Likewise, the retard oil passage 60 includes a first retard oil passage 60A formed at the camshaft 14 and a second retard oil passage 60B formed at the vane rotor 12.

The control unit 50 controls the rotation position of the vane rotor 12 relative to the housing 11 (the relative rotation position of the vane rotor 12 to the housing 11) and consequently controls the valve timing of the intake valve by controlling a duty ratio of the signal outputted to the first solenoid 52 according to an engine operating condition.

More specifically, when the control unit 50 stops power supply (current supply) to the first solenoid 52 with the duty ratio of the output signal being 0%, the first spool 54 moves to a right side in FIG. 1 by the spring force of the first return spring 53 and is positioned at a retard angle position 65. In this case, the hydraulic pressure supply passage 56 communicates with the retard oil passage 60, and the hydraulic pressure is supplied to the retard working chamber 47 through the hydraulic pressure supply passage 56 and the retard oil passage 60. On the other hand, the advance oil passage 59 communicates with the drain passage 58, and the working fluid in the advance working chamber 46 is exhausted to the oil pan 57 side through the advance oil passage 59 and the drain passage 58, then the vane rotor 12 rotates relative to the housing 11 in a retard angle direction 87 (see FIGS. 5A, 6A and 7A).

On the other hand, when the duty ratio is 100%, the first spool 54 moves to a left side in FIG. 1 against the spring force of the first return spring 53 and is positioned at an advance angle position 66. In this case, the hydraulic pressure supply passage 56 communicates with the advance oil passage 59, and the hydraulic pressure is supplied to the advance working chamber 46 through the hydraulic pressure supply passage 56 and the advance oil passage 59. On the other hand, the retard oil passage 60 communicates with the drain passage 58, and the working fluid in the retard working chamber 47 is exhausted to the oil pan 57 side through the retard oil passage 60 and the drain passage 58, then the vane rotor 12 rotates relative to the housing 11 in an advance angle direction 88 (see FIGS. 5A, 6A and 7A).

Further, when the duty ratio is 50%, the first spool 54 is positioned at a substantially middle holding position 67. In this case, the advance oil passage 59 and the retard oil passage 60 are both closed (interrupted), and each hydraulic pressure of the advance working chamber 46 and the retard working chamber 47 is maintained, then the rotation position of the vane rotor 12 relative to the housing 11 is maintained at a current position.

Figure 2:
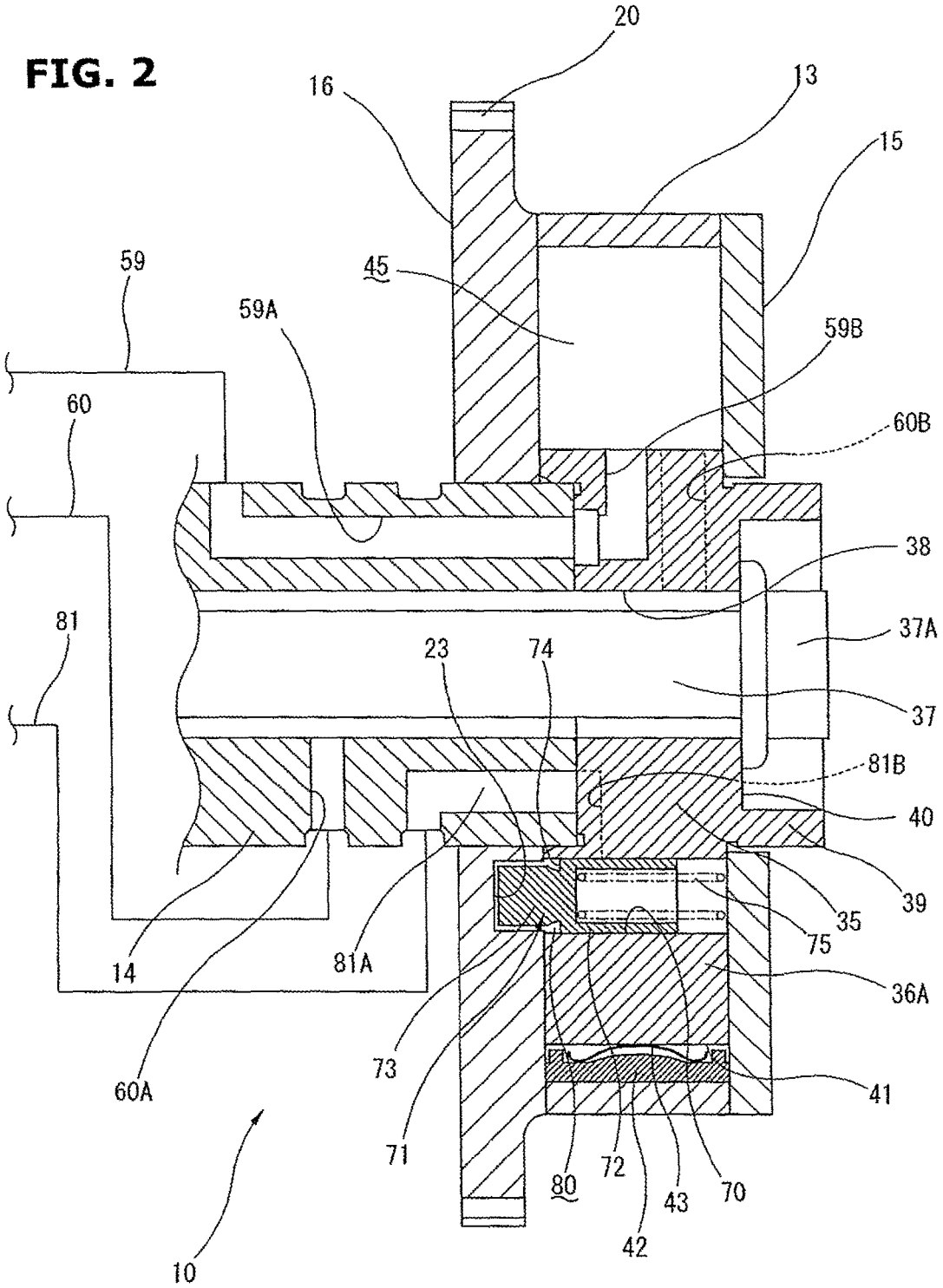
FIG. 2 is an enlarged sectional view of a main part of the valve timing control device.

In the valve timing control device 10 of the present embodiment, a middle position lock mechanism that mechanically restrains and holds the relative rotation position of the vane rotor 12 to the housing 11 at a predetermined middle lock position (a lock position) is provided. As shown in FIGS. 1 and 2, this middle position lock mechanism has two lock pins 71 as lock members that are accommodated movably in an axial direction in two lock pin accommodation holes 70 formed in the axial direction close to respective large diameter portions 85 of the vane rotor 12. Each lock pin 71 has a cylindrical base end portion 72 and a top end portion 73 whose diameter is smaller than that of the base end portion 72. A pressure receiving surface 74 is formed at a stepped portion between the base end portion 72 and the top end portion 73.

As shown in FIGS. 1 and 2, the top end portions 73 of these two lock pins 71 protrude from the axial direction side surface of the vane rotor 12 and are fitted into the two lock holes 23 (23A and 23B) recessed at an axial direction side surface of the rear plate 16, thereby restraining (limiting) the relative rotation position between the vane rotor 12 and the housing 11 at the predetermined middle lock position. The middle lock position at this time corresponds to a start valve timing suitable for an engine start from an engine stop state, and as described later, this lock position is positioned at a relatively retarded angle side in light of startability (see FIG. 6).

The middle position lock mechanism has a lock return spring 75 that forces the lock pin 71 to a protruding direction and the second electromagnetic switching valve 76 as a lock control unit that changes an axial direction position of the lock pin 71. As shown in FIG. 1, the second electromagnetic switching valve 76 controls movement of the lock pin 71 by switching (changing) a hydraulic pressure of a lock release pressure chamber 80 that faces the pressure receiving surface 74 of the lock pin 71 by the fact that a second solenoid 77 changes a position of a second spool 78 according to a signal from the control unit 50. The hydraulic pressure supply passage 56, the drain passage 58 and a lock release passage 81 that communicates with the lock release pressure chamber 80 are connected to the second electromagnetic switching valve 76. The lock release passage 81 includes a first lock release passage 81A formed at the camshaft 14 and a second lock release passage 81B formed at the vane rotor 12. As shown in FIG. 8, a part of the second lock release passage 81B is recessed on the axial direction side surface of the vane rotor 12.

When power supply (current supply) to the second solenoid 77 is stopped like a time of the engine stop, the second spool 78 moves to a right side in FIG. 1 by a spring force of a second return spring 79 and is positioned at a lock position 82, then the lock release passage 81 communicates with the drain passage 58. With this communication, the working fluid in the lock release pressure chamber 80 is exhausted to the oil pan 57 side through the lock release passage 81 and the drain passage 58, and the lock pin 71 moves in the protruding direction (to left direction in FIGS. 1 and 2). Therefore, as described above, by the top end portions 73 of the two lock pins 71 being fitted into the two lock holes 23 (23A and 23B), the relative rotation position of the vane rotor 12 to the housing 11 is mechanically restrained. With this, when the engine stops, the relative rotation position is maintained at the middle lock position suitable for next engine start. In order for the top end portions 73 of the two lock pins 71 to be fitted into the two lock holes 23 (23A and 23B) smoothly, one of the two lock holes 23 is a long hole 23A that extends in a circumferential direction of the rear plate 16 (see FIG. 3).

Here, by the lock pin 71 being fitted into the lock hole 23A, the relative rotation position of the vane rotor 12 to an advance angle side with respect to the housing 11 is limited, and by the lock pin 71 being fitted into the lock hole 23B, the relative rotation position of the vane rotor 12 to a retard angle side with respect to the housing 11 is limited, thereby maintaining the relative rotation position at the middle lock position. Further, since the lock hole 23A is formed into the long hole, the lock pin 71 is easily fitted into the lock hole 23A as compared with the lock hole 23B. Therefore, a rotation of the vane rotor 12 relative to the housing 11 is limited to some extent with the lock pin 71 being fitted into the lock hole 23A, then the lock pin 71 can be readily fitted into the lock hole 23B. Further, by this structure, for instance, even in a case where the engine stalls during an engine operating state and the engine stops with the lock pins 71 not being fitted into the lock holes 23 (23A and 23B), the camshaft 14 wobbles or rotates in forward and backward directions by an alternating torque at the next engine start, and thus the lock pins 71 can be easily fitted into the lock holes 23 (23A and 23B). Hence, it is possible to fit the lock pins 71 into the lock holes 23 (23A and 23B) early and promptly, and the engine start with the relative rotation being at the middle lock position can easily be carried out.

On the other hand, during the engine operating state, basically, by supplying the power (the current) to the second solenoid 77, the second spool 78 moves to a left side in FIG. 1 and is positioned at a lock release position 83. The lock release passage 81 then communicates with the hydraulic pressure supply passage 56, and the lock pin 71 moves in an opposite protruding direction (in a right direction in FIGS. 1 and 2) by the hydraulic pressure supplied to the lock release pressure chamber 80 against a spring force of the lock return spring 75. The top end portion 73 of the lock pin 71 is therefore accommodated in the vane rotor 12. That is, the whole lock pin 71 is sheltered from the housing 11. With this working, the relative rotation between the vane rotor 12 and the housing 11 is allowed.

Figure 5A:
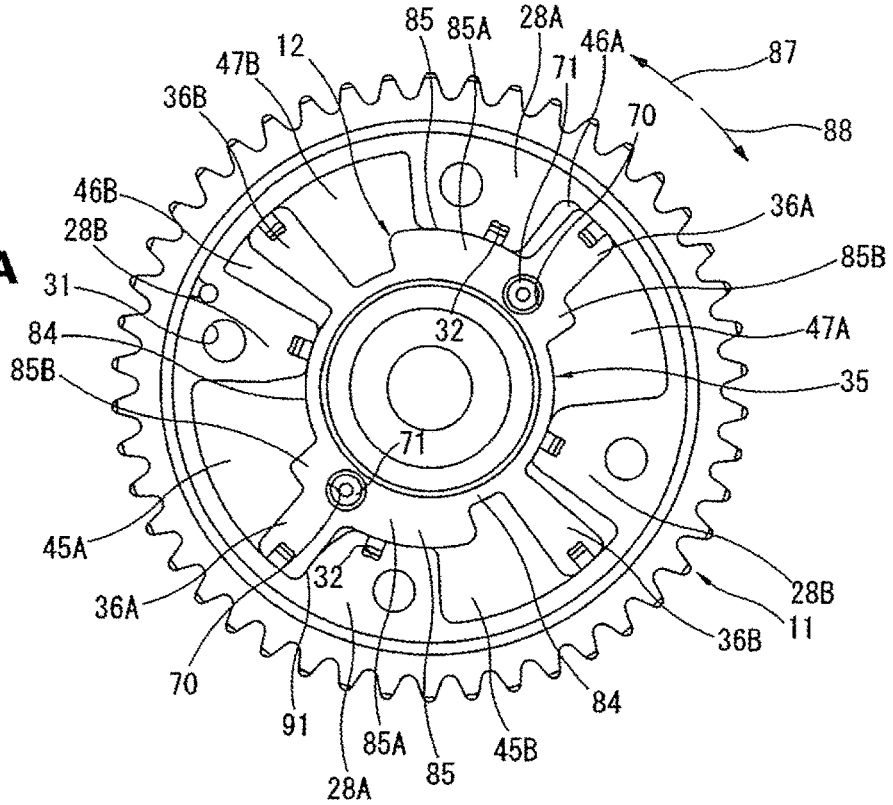
FIG. 5A is a front view showing a state in which a relative rotation position of a vane rotor relative to a housing of the valve timing control device is positioned at a most-retarded angle position.
Figure 5B:
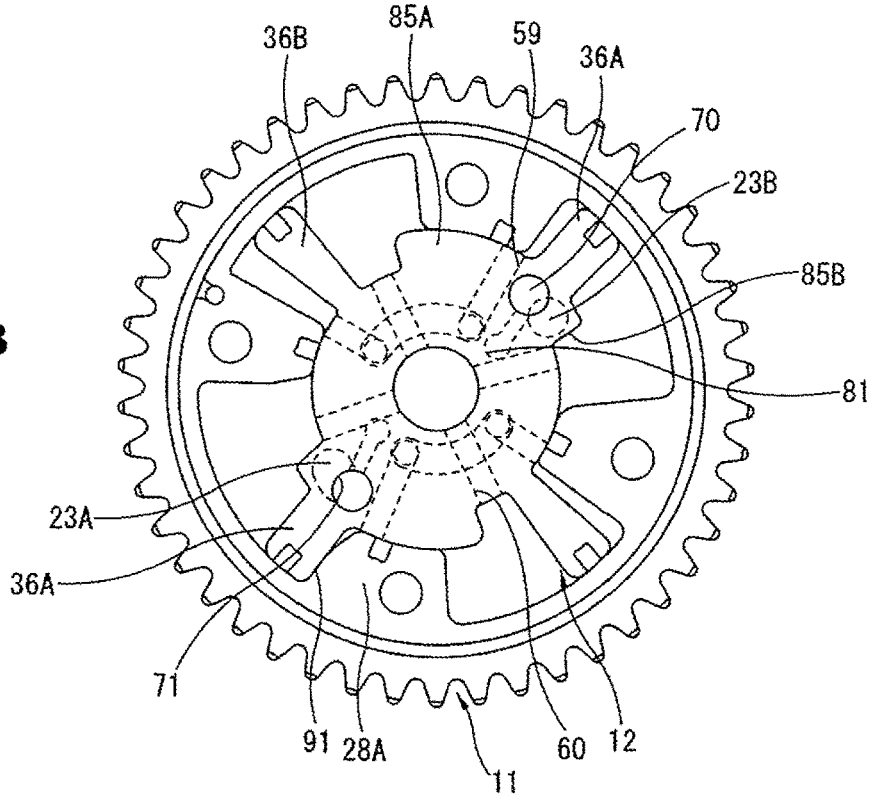
FIG. 5B is a skeleton diagram of FIG. 5A.
Figure 6A:
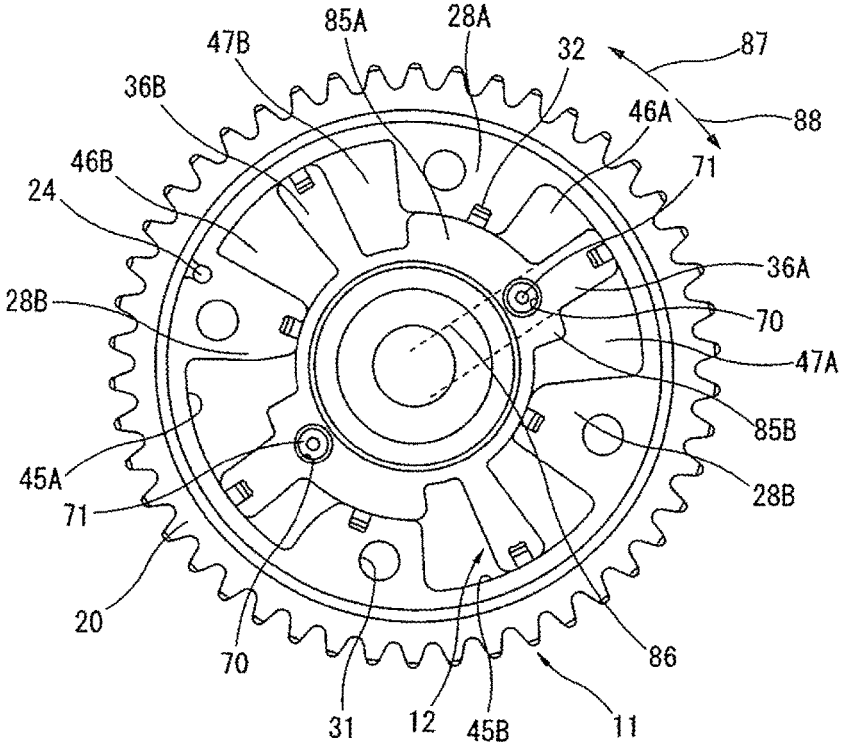
FIG. 6A is a front view showing a state in which the relative rotation position is positioned at a middle lock position.
Figure 6B:
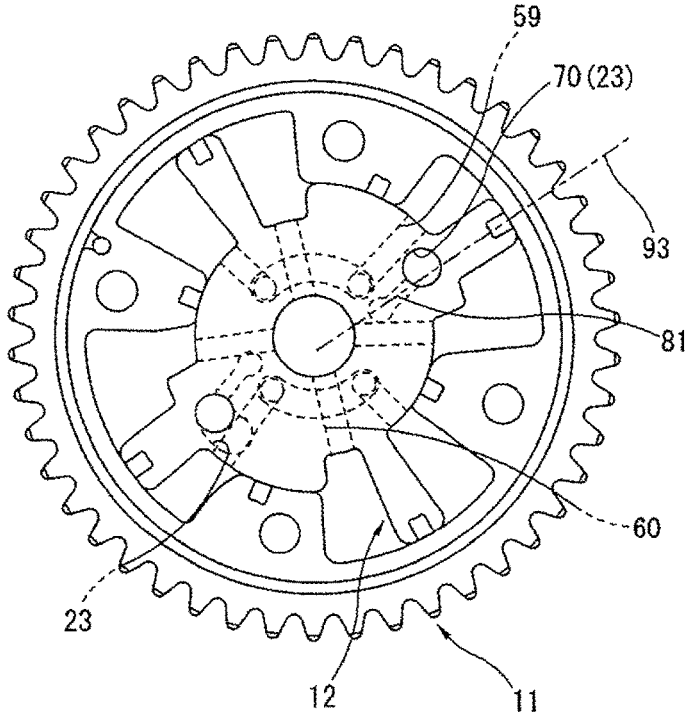
FIG. 6B is a skeleton diagram of FIG. 6A.
Figure 7A:
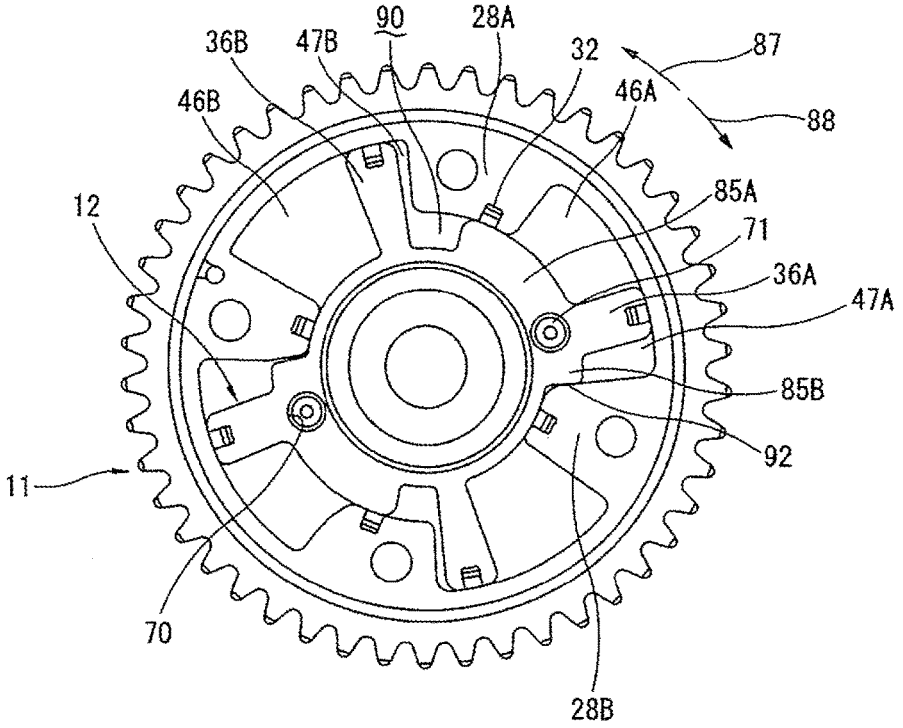
FIG. 7A is a front view showing a state in which the relative rotation position is positioned at a most-advanced angle position.
Figure 7B:
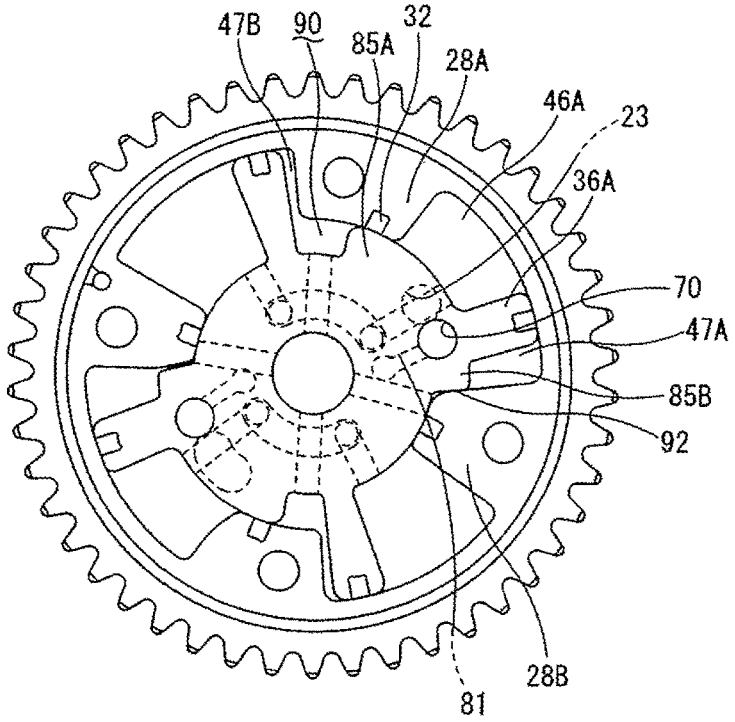
FIG. 7B is a skeleton diagram of FIG. 7A.

Next, a structure of a main part of the present embodiment will be explained in detail. FIGS. 5A, 6A and 7A are front view of the vane rotor 12 and the housing 11 with the front plate 15 removed, viewed from a front side (from a left side in FIG. 3). FIGS. 5B, 6B and 7B are skeleton diagrams with the lock holes 23 (23A and 23B), the advance oil passage 59, the retard oil passage 60 and the lock release passage 81 being transparent. Further, FIG. 8 is a back view of the vane rotor 12, viewed from a back side (from a right side in FIG. 3).

As shown in FIGS. 3, 5A to 7B, two small diameter portions 84 and two large diameter portions 85 whose radial direction size is larger than that of the small diameter portion 84 are formed alternately in a circumferential direction of the vane rotor 12 at the rotor core 35 forming the cylindrical shape of the vane rotor 12. The two small diameter portions 84 are arranged at symmetrical positions of substantially 180 degrees which are opposite sides of the axis of the vane rotor 12. Likewise, the two large diameter portions 85 are arranged at symmetrical positions of substantially 180 degrees which are opposite sides of the axis of the vane rotor 12. The large diameter portion 85 has a sector shape that partly overhangs or extends to the radially outer side with respect to the small diameter portion 84. The large diameter portion 85 extends in the circumferential direction so as to cover the lock holes 23 (23A and 23B) all the time regardless of the relative rotation position between the vane rotor 12 and the housing 11 in order that the lock holes 23 (23A and 23B) are not open to the working chamber 45.

Here, two of the four vanes 36 provided at the vane rotor 12 are first vanes 36A that protrude from outer peripheries of the respective large diameter portions 85 to the radially outer side, and the other two vanes are second vanes 36B that protrude from outer peripheries of the respective small diameter portions 84 to the radially outer side. Therefore, a radial direction size of the first vane 36A is shorter than that of the second vane 36B. The two first vanes 36A are arranged at symmetrical positions of substantially 180 degrees which are opposite sides of the axis of the vane rotor 12. Likewise, the two second vanes 36B arranged at symmetrical positions of substantially 180 degrees which are opposite sides of the axis of the vane rotor 12. That is, the first vane 36A and the second vane 36B are formed alternately in the circumferential direction of the vane rotor 12 and arranged at substantially regular intervals of 90 degrees in the circumferential direction.

The second vane 36B extending from the small diameter portion 84 to the radially outer side is inferior to the first vane 36A in rigidity since the radial direction size of the second vane 36B is longer than that of the first vane 36A. However, as described later, since the second vane 36B is formed such that the second vane 36B does not contact the shoe 28 in the circumferential direction, there is no need to ensure the rigidity with respect to the contact with the shoe 28 in the circumferential direction. Therefore, in order to set a width in the circumferential direction of the second vane 36B to be thinner than that of the first vane 36A and lighten the second vane 36B and increase a volume of the working chamber 45 while ensuring sealing performance (sealing function) of a tip end of the second vane 36B, the second vane 36B is shaped such that a thickness in the circumferential direction of the second vane 36B is gradually smaller toward the small diameter portion 84 in the radially inner side, namely, that the second vane 36B is shaped such that a root portion of the second vane 36B which is connected to the small diameter portion 84 is thinnest in the circumferential direction.

Two of the four shoes 28 provided at the housing body 13 of the housing 11 are first shoes 28A whose tip end makes sliding contact with the outer periphery of the large diameter portion 85. The other two shoes are second shoes 28B whose tip end makes sliding contact with the outer periphery of the small diameter portion 84. Therefore, a radial direction size of the first shoe 28A is shorter than that of the second shoe 28B. The two first shoes 28A are arranged at symmetrical positions of substantially 180 degrees which are opposite sides of the axis of the housing body 13. Likewise, the two second shoes 28B are arranged at symmetrical positions of substantially 180 degrees which are opposite sides of the axis of the housing body 13. That is, the first shoe 28A and the second shoe 28B are formed alternately in the circumferential direction of housing body 13 and arranged at substantially regular intervals of 90 degrees in the circumferential direction.

In this manner, by arranging the plurality of small diameter portions 84, large diameter portions 85, vanes 36 and shoes 28 at symmetrical positions which are opposite sides of the axis respectively, the advance working chamber 46 and the retard working chamber 47 which have substantially same shape and size are arranged at symmetrical positions which are opposite sides of the axis, thereby achieving a well-balanced layout.

The four working chambers 45 are formed by two first working chambers 45A and two second working chambers 45B. The first working chamber 45A is divided or partitioned off into a first advance working chamber 46A and a first retard working chamber 47A by the first vane 36A. The second working chamber 45B is divided or partitioned off into a second advance working chamber 46B and a second retard working chamber 47B by the second vane 36B. The first advance working chamber 46A is formed between the first vane 36A and the first shoe 28A. The first retard working chamber 47A is formed between the first vane 36A and the second shoe 28B. The second advance working chamber 46B is formed between the second vane 36B and the second shoe 28B. The second retard working chamber 47B is formed between the second vane 36B and the first shoe 28A.

The lock pin 71 and the lock pin accommodation hole 70 accommodating therein the lock pin 71 are located at a position of the large diameter portion 85 positioned at the radially inner side of the first vane 36A, viewed from an axial direction of the vane rotor 12. That is, the lock pin 71 is arranged such that at least a part of the lock pin 71 overlaps with the large diameter portion 85 and at least an axial center of the lock pin 71 is located at a position that overlaps with an area 86 formed by elongating the first vane 36A to the radially inner side, viewed from an axial direction of the vane rotor 12. More specifically, centers of the lock pin 71 and the lock pin accommodation hole 70 are positioned at the radially inner side with respect to the outer periphery of the large diameter portion 85 and at the radially outer side with respect to an inner periphery of the small diameter portion 84 and also at an inner side of the area 86 formed by extending the first vane 36A to the radially inner side.

Here, depending on size of the lock pin 71, in a case where the lock pin 71 is relatively large, a part of the lock pin 71 and a part of the lock pin accommodation hole 70 are arranged so as to necessarily reach the small diameter portion 84. On the other hand, in a case where the lock pin 71 is relatively small, preferably, the whole lock pin 71 and the whole lock pin accommodation hole 70 are arranged only at the inner side of the large diameter portion 85 without overlapping with the small diameter portion 84.

The large diameter portion 85 of the vane rotor 12 extends to both sides from a position of the first vane 36A in the circumferential direction. That is, the large diameter portion 85 has a first large diameter portion 85A that extends in the retard angle direction 87 (in a first direction) from the position of the first vane 36A and a second large diameter portion 85B that extends in the advance angle direction 88 (in a second direction) from the position of the first vane 36A. The first large diameter portion 85A is set to be longer in the circumferential direction than that of the second large diameter portion 85B.

Here, the middle lock position used when starting the engine is positioned at a slightly retarded angle side within a relatively rotatable range of the vane rotor 12 with respect to the housing 11 for improving startability with an internal EGR secured. Therefore, an angle at which the vane rotor 12 can rotate relative to the housing 11 to the retard angle direction 87 from the middle lock position, i.e. a movable range of the vane rotor 12 to the retard angle direction 87 from the middle lock position, is smaller than a movable range of the vane rotor 12 to the advance angle direction 88 from the middle lock position. That is, in the present embodiment, regarding the large diameter portion 85 extending to both sides from the position of the first vane 36A and having the first large diameter portion 85A and the second large diameter portion 85B, the first large diameter portion 85A extending in the retard angle direction 87 where the movable range from the middle lock position is smaller is set to be longer in the circumferential direction, whereas the second large diameter portion 85B extending in the advance angle direction 88 where the movable range from the middle lock position is larger is set to be shorter in the circumferential direction.

Then, the tip end of the first shoe 28A makes sliding contact with the outer periphery of the first large diameter portion 85A that is longer in the circumferential direction. That is, the first large diameter portion 85A is set to be longer in the circumferential direction and the first shoe 28A is set to be longer than the second shoe 28B in the circumferential direction such that a tip end of the outer periphery of the first large diameter portion 85A and a tip end of an inner periphery of the first shoe 28A are in sliding contact with each other all the time regardless of the relative rotation position of the vane rotor 12 to the housing 11. Further, the first shoe 28A makes sliding contact with the tip end of the first large diameter portion 85A at a position of the first seal member 33 accommodated in the first seal groove 32. Therefore, a position of the first seal groove 32 is located at a first vane 36A side of the first shoe 28A, i.e. at an advance angle direction 88 side of the first shoe 28A. Accordingly, as shown in FIGS. 7A and 7B, even at the most-advanced angle position, the first large diameter portion 85A and the first shoe 28A are in sliding contact with each other, a length in the circumferential direction of the first large diameter portion 85A can be as short as possible, and a groove-shaped space 90 can be secured between the first large diameter portion 85A and the second vane 36B that is adjacent to the first large diameter portion 85A in the retard angle direction 87 with a part of the small diameter portion 84 remaining between the first large diameter portion 85A and the second vane 36B.

On the other hand, a length in the circumferential direction of the second large diameter portion 85B is set to be as short as possible within a range that covers the lock hole 23 even in a case where the relative rotation position of the vane rotor 12 to the housing 11 is at the most-retarded angle position as shown in FIG. 5B.

As shown in FIGS. 5A and 5B, at the most-retarded angle position at which the vane rotor 12 rotates relative to the housing 11 in the most-retarded angle direction 87, a circumferential direction side surface of one of the first vanes 36A and a circumferential direction side surface of one of the first shoes 28A which faces the one of the first vanes 36A contact each other only at one portion (one point) 91. With this contact, the relative rotation position of the vane rotor 12 to the housing 11 is mechanically restrained at the most-retarded angle position. Since the first vane 36A whose radial direction length is shorter than that of the second vane 36B and whose rigidity can be ensured more easily than the second vane 36B contacts the first shoe 28A at the most-retarded angle position in this manner, as compared with a case where the second vane 36B whose radial direction length is longer and which has difficulty of ensuring the rigidity contacts the second shoe 28B, durability and reliability are increased. Further, a contact point is the one portion 91, and the other vane and the other shoe are in a separate state from each other in the circumferential direction, thereby readily ensuring rigidity of these vane and shoe. Here, if the contact point is set to two points or more, there arises a problem of not ensuring stability because the contact point is not stable due to variations in size. However, by limiting the contact point to the one portion 91, such a problem does not arise.

Further, regarding the contact point, in order that the first vane 36A surely contacts the first shoe 28A from an outer peripheral side and a root side of the first shoe 28A, the circumferential direction side surface of the first shoe 28A is shaped into a tapered surface (a sloping surface) that slopes with respect to the circumferential direction side surface of the first vane 36A.

As shown in FIGS. 7A and 7B, at the most-advanced angle position at which the vane rotor 12 rotates relative to the housing 11 in the most-advanced angle direction 88, a circumferential direction side surface of one (the second large diameter portion 85B) of the large diameter portions 85 and a circumferential direction side surface of one of the second shoes 28B which faces the one of the large diameter portions 85 contact each other only at one portion (one point) 92. With this contact, the relative rotation position of the vane rotor 12 to the housing 11 is mechanically restrained at the most-advanced angle position. Since the large diameter portion 85 (the second large diameter portion 85B) which is thicker than the vane 36 and has higher rigidity than that of the vane 36 contacts the second shoe 28B in the circumferential direction at the most-advanced angle position in this manner, as compared with a case where the vane 36 contacts the second shoe 28B, durability and reliability are greatly increased. Further, in the same manner as the most-retarded angle position, by limiting the contact point to the one portion 92, it is possible to ensure rigidity of the other vane and the other shoe, and the problem of not ensuring stability due to the fact that the contact point is not stable does not arise.

In the following, distinctive structure and effect of the above embodiment will be described.

[1] The small diameter portion 84 and the large diameter portion 85 whose radial direction size is larger than that of the small diameter portion 84 are formed alternately in the circumferential direction of the vane rotor 12 at the vane rotor 12. The large diameter portion 85 extends in the circumferential direction so as to cover the lock hole 23 all over the relatively rotatable range of the vane rotor 12 with respect to the housing 11. The first vane 36A protrudes from the outer periphery of the large diameter portion 85 to the radially outer side.

As a first distinctive structure of the present embodiment, as shown in FIGS. 5A to 7B, the lock pin 71 and the lock pin accommodation hole 70 are located such that, viewed from the axial direction of the vane rotor 12, at least a part of the lock pin 71 and at least a part of the lock pin accommodation hole 70 overlap with the large diameter portion 85, and the axial centers of the lock pin 71 and the lock pin accommodation hole 70 are located at the position that overlaps with the area 86 formed by elongating, to the radially inner side, a crossing area between the large diameter portion 85 extending in the circumferential direction and the first vane 36A extending in the radial direction. That is, the lock pin 71 and the lock pin accommodation hole 70 are located close to the crossing area between the large diameter portion 85 extending in the circumferential direction and the first vane 36A extending in the radial direction and close to the large diameter portion 85 at the radially inner side of the first vane 36A. Here, a shape of the first vane 36A is not necessarily a parallel shape. For instance, it could be a shape similar to the second vane 36B as long as the first vane 36A is located at a position that overlaps with the area 86 formed by elongating, to the radially inner side, the crossing area between the large diameter portion 85 extending in the circumferential direction and the first vane 36A.

Here, if the lock pin 71 and the lock pin accommodation hole 70 are located at a position that is widely separate from the first vane 36A in the circumferential direction at the large diameter portion 85, in order to secure a measure of thickness around the lock pin accommodation hole 70, it is necessary to increase the radial direction size of the large diameter portion 85 to some extent. In contrast to this, in the present embodiment, the first vane 36A is located at the radially outer side of the lock pin accommodation hole 70 of the lock pin 71. Consequently, even if the radial direction position of the lock pin accommodation hole 70 gets closer to the outer peripheral side of the large diameter portion 85, since the first vane 36A is present, a measure of thickness around the lock pin accommodation hole 70 can be secured by an amount (a thickness) equivalent to the presence of the first vane 36A. Hence, it is possible to set the radial direction size of the large diameter portion 85 to be as small as possible while securing a predetermined thickness around the lock pin accommodation hole 70 with the lock pin 71 and the lock pin accommodation hole 70 located at the large diameter portion 85. With this, since the radial direction size of the first vane 36A extending from the outer periphery of the large diameter portion 85 to the radially outer side can be set to be relatively long and a pressure receiving area of this first vane 36A can be increased, response of the rotation of the vane rotor 12 relative to the housing 11 is increased, and consequently response of a valve timing change is increased. Further, since the pressure receiving area of this first vane 36A is increased, the volume of the working chamber 45 can be increased, then holding performance of the working fluid is improved. In addition, by reducing the size of the large diameter portion 85, size reduction and weight reduction of the vane rotor 12 can be realized, and an entire volume of the working chamber 45 with respect to a size of the housing 11 can be increased, then this brings about size reduction of the housing 11. As a consequence, a size of the valve timing control device 10 can be reduced. Furthermore, if the volume of the working chamber 45 is small, when air enters the working chamber 45 upon start of the engine, a ratio of entrapped air (mixing air) is increased, then there is a risk that workings of the vane rotor 12 will become unstable. However, in the present embodiment, by increasing the volume of the working chamber 45, an influence of the air entering the working chamber 45 can be decreased, and working stability can be increased.

[2] Among the first large diameter portion 85A extending in the retard angle direction 87 from the position of the first vane 36A and the second large diameter portion 85B extending in the advance angle direction 88 from the position of the first vane 36A, the first large diameter portion 85A extending in the retard angle direction 87 where the movable range from the lock position is smaller is set to be longer in the circumferential direction than that of the second large diameter portion 85B extending in the advance angle direction 88 where the movable range from the lock position is larger.

That is, by providing, in an opposite direction (in the retard angle direction 87) to the advance angle direction 88 where the movable range from the lock position 82 is larger, the first large diameter portion 85A whose circumferential direction size is longer, even in a case where the vane rotor 12 relatively rotates to the advance angle direction 88 with respect to the lock position 82, the lock hole 23 can surely be covered with the first large diameter portion 85A. In other words, since the circumferential direction size of the second large diameter portion 85B extending in an opposite direction (in the advance angle direction 88) to the retard angle direction 87 where the movable range from the lock position 82 is smaller can be adequately shortened, a volume of the large diameter portion 85 is suppressed, and size reduction and weight reduction of the valve timing control device 10 can be realized, and also the influence of the air entering the working chamber 45 can be decreased.

[3] If the first shoe 28A extends until the first shoe 28A makes sliding contact with the inner periphery of the small diameter portion 84, in order to prevent this first shoe 28A from interfering with the circumferential direction side surface of the large diameter portion 85 in the circumferential direction, the circumferential direction length and position of the large diameter portion 85 are widely limited, then a design becomes difficult. In the present embodiment, since the first shoe 28A and the large diameter portion 85 are configured such that the tip end of the first shoe 28A makes sliding contact with the outer periphery of the first large diameter portion 85A that is longer in the circumferential direction, the interference of the first shoe 28A with the first large diameter portion 85A is avoided, then degree of freedom of the design including the circumferential direction length and position of the first large diameter portion 85A is increased. Further, by making the first shoe 28A in sliding contact with the first large diameter portion 85A whose circumferential direction size is longer, it is possible to easily maintain the sliding contact between both the first shoe 28A and the first large diameter portion 85A all the time regardless of the relative rotation position of the vane rotor 12. In other words, by not making the shoe in sliding contact with the outer periphery of the second large diameter portion 85B whose circumferential direction size is shorter, the circumferential direction size of the second large diameter portion 85B is greatly shortened within a range that covers the lock hole 23, and the volume of the large diameter portion is reduced.

[4] The second vane 36B that is adjacent to the first vane 36A protrudes from the outer periphery of the small diameter portion 84 to the radially outer side. Then, the first advance working chamber 46A is formed between the first shoe 28A and the first vane 36A. The second retard working chamber 47B is formed between the first shoe 28A and the second vane 36B. That is, the advance working chamber is formed at the first vane 36A side with respect to the first shoe 28A, and the retard working chamber is formed at the second vane 36B side with respect to the first shoe 28A. Therefore, although the first advance working chamber 46A at the first vane 36A side does not face the small diameter portion 84, the second retard working chamber 47B at the second vane 36B side faces a part of the small diameter portion 84, thereby securing a relatively large volume of the second retard working chamber 47B. Accordingly, as mentioned above, it is possible to effectively reduce the influence of the air when supplying the working fluid into the retard working chamber upon start of the engine.

[5] A part of the small diameter portion 84 remains between the second vane 36B and the first large diameter portion 85A. Therefore, the groove-shaped space 90 is formed at the radially outer side of the small diameter portion 84 between the second vane 36B and the first large diameter portion 85A. The volume of the retard working chamber 47 can be thus secured by a volume equivalent to this groove-shaped space 90. Further, regarding the second vane 36B, the small diameter portion 84 extends to circumferential direction both sides of the second vane 36B, and the second vane 36B does not contact or does not continue to the large diameter portion 85. Therefore, a pressure receiving area of the second vane 36B can be adequately increased.

[6] The first vane 36A is provided at two positions which are opposite sides of the axis of the vane rotor 12, and the second vane 36B is provided at two positions which are opposite sides of the axis of the vane rotor 12. That is, the first vane 36A and the second vane 36B are provided alternately in the circumferential direction of the vane rotor 12 and arranged at substantially regular intervals of 90 degrees in the circumferential direction. A well-balanced layout can be thus achieved.

[7] Regarding the second shoe 28B that is adjacent to the first shoe 28A, the inner periphery of the second shoe 28B faces the outer periphery of the small diameter portion 84 through the slight gap. That is, the second shoe 28B is configured to make sliding contact with not the large diameter portion 85 but the small diameter portion 84.

[8] The vane rotor 12 and the housing 11 are configured such that when the vane rotor 12 rotates relative to the housing 11 in the most-retarded angle direction 87, the circumferential direction side surface of the first vane 36A contacts the circumferential direction side surface of the first shoe 28A. Since the first vane 36A whose radial direction length is shorter than that of the second vane 36B and whose rigidity can be ensured more easily than the second vane 36B contacts the first shoe 28A at the most-retarded angle position in this manner, as compared with a case where the second vane 36B contacts the second shoe 28B, durability and reliability are increased.

[9] On the other hand, the vane rotor 12 and the housing 11 are configured such that when the vane rotor 12 rotates relative to the housing 11 in the most-advanced angle direction 88, the circumferential direction side surface of the second large diameter portion 85B contacts the circumferential direction side surface of the second shoe 28B. Since the second large diameter portion 85B which is thicker than the vane 36 and has higher rigidity than that of the vane 36 contacts the second shoe 28B in the circumferential direction at the most-advanced angle position in this manner, as compared with a case where the vane 36 contacts the second shoe 28B, durability and reliability are greatly increased.

[10] As shown in FIG. 1, the second electromagnetic switching valve 76 as the lock control unit changes the axial direction position of the lock pin 71 (the lock member) by controlling the hydraulic pressure supplied to the lock working chamber 45 facing the lock pin 71. This second electromagnetic switching valve 76 is provided independently of the first electromagnetic switching valve 51 as the valve timing control unit. Therefore, a valve timing control by the first electromagnetic switching valve 51 and a control of the lock pin 71 by the second electromagnetic switching valve 76 can be carried out independently according to the engine operating condition.

[11] It is not necessarily required that the lock pin 71 is positioned so as to be identical with (so as to be aligned on) a radial direction center line 93 of the first vane 36A. A position of the lock pin 71 could be shifted to some extent in the circumferential direction according to requirement of the layout. For instance, in the above embodiment, as shown in FIGS. 6B and 8, the lock pin 71 and the lock pin accommodation hole 70 are slightly offset in the retard angle direction 87 from the radial direction center line 93 of the first vane 36A. Since the lock pin 71 and the lock pin accommodation hole 70 are offset in the retard angle direction 87 where the first large diameter portion 85A whose circumferential direction length is longer and whose volume is greater exists in this manner, as compared with a case where the lock pin 71 and the lock pin accommodation hole 70 are offset in the advance angle direction 88, the thickness around the lock pin accommodation hole 70 is easy to secure.

[12] As a second distinctive structure of the present embodiment, the first vane 36A protruding from the outer periphery of the large diameter portion 85 to the radially outer side and the second vane 36B protruding from the outer periphery of the small diameter portion 84 to the radially outer side are arranged alternately in the circumferential direction, and the small diameter portion 84 remains between the large diameter portion 85 and the second vane 36B. That is, the circumferential direction both sides of the second vane 36B are not connected or do not continue to the large diameter portion 85, and a part of the small diameter portion 84 remains. Therefore, it is possible to secure a relatively large volume of the working chamber 45. Further, as mentioned above, effects of reducing the size and weight of the valve timing control device 10 and decreasing the influence of the entering air can be obtained.

Moreover, since the circumferential direction both sides of the second vane 36B are connected or continue to the small diameter portion 84, a sufficient pressure receiving area of the second vane 36B can be secured. Therefore, response of change of the relative rotation position of the vane rotor 12 to the housing 11 is increased, and consequently response of the valve timing change is increased.

Although the present invention has been explained on the basis of the above embodiment, the present invention is not limited to the above embodiment, but includes all design modifications and equivalents belonging to the technical scope of the present invention. For instance, in the above embodiment, the present invention is applied to the intake valve side of an internal combustion engine. However, the present invention can be applied to an exhaust valve side.

Further, either one of the front plate 15 and the rear plate 16 could be formed integrally with the housing body 13.

Furthermore, the lock hole 23 is formed at the rear plate 16. However, the lock hole 23 could be formed at the front plate 15.

As the valve timing control device for the internal combustion engine based on the embodiment explained above, for instance, the followings are raised.

As one aspect of the present invention, a valve timing control device for an internal combustion engine comprises: a housing having a cylindrical portion that has a cylindrical shape, a first side portion that closes an axial direction one end side of the cylindrical portion and a second side portion that closes an axial direction other side of the cylindrical portion and rotating with a crankshaft; a vane rotor relatively rotatably disposed at a radially inner side of the cylindrical portion of the housing and rotating with a camshaft; a plurality of shoes protruding from an inner periphery of the cylindrical portion of the housing to the radially inner side; a plurality of vanes protruding from an outer periphery of the vane rotor to a radially outer side and dividing a working chamber formed between two shoes that are adjacent to each other in a circumferential direction into a retard working chamber and an advance working chamber; a lock member provided movably in an axial direction in an accommodation hole formed at the vane rotor; and a lock hole opening in the axial direction at the first side portion of the housing and restraining a relative rotation position of the vane rotor to the housing by a top end portion of the lock member being fitted into the lock hole. And, the vane rotor has a small diameter portion and a large diameter portion whose radial direction size is larger than that of the small diameter portion. The large diameter portion extends in the circumferential direction so as to cover the lock hole all over a relatively rotatable range of the vane rotor with respect to the housing. The plurality of vanes include a first vane that protrudes from an outer periphery of the large diameter portion to the radially outer side. And, at least a part of the accommodation hole is provided at the large diameter portion and located at a position that overlaps with an area formed by elongating the first vane to the radially inner side, viewed from an axial direction of the vane rotor.

As a preferable aspect of the present invention, when defining a direction where a movable range in which the vane rotor can rotate relative to the housing from a lock position in the circumferential direction is smaller as a first direction, and defining a direction opposite to the first direction as a second direction, the large diameter portion includes a first large diameter portion that extends in the first direction from a position of the first vane and a second large diameter portion that extends in the second direction from the position of the first vane, and a length in the circumferential direction of the first large diameter portion is set to be longer than that of the second large diameter portion.

As another preferable aspect of the present invention, the plurality of shoes include a first shoe whose tip end makes sliding contact with an outer periphery of the first large diameter portion.

As another preferable aspect of the present invention, the plurality of vanes include a second vane that is adjacent to the first vane in the circumferential direction, the second vane protrudes from an outer periphery of the small diameter portion to the radially outer side, the advance working chamber is formed between the first shoe and the first vane, and the retard working chamber is formed between the first shoe and the second vane.

As another preferable aspect of the present invention, a part of the small diameter portion remains between the second vane and the large diameter portion.

As an example, the first vane is provided at two positions which are opposite sides of an axis of the vane rotor, and the second vane is provided at two positions which are opposite sides of the axis of the vane rotor.

For instance, the plurality of shoes include a second shoe which is adjacent to the first shoe in the circumferential direction and whose tip end makes sliding contact with the small diameter portion.

As another preferable aspect of the present invention, when the vane rotor rotates relative to the housing the most in the first direction, a circumferential direction side surface of the first vane contacts a circumferential direction side surface of the first shoe.

As another preferable aspect of the present invention, when the vane rotor rotates relative to the housing the most in the second direction, a circumferential direction side surface of the second large diameter portion contacts a circumferential direction side surface of the second shoe.

As another preferable aspect of the present invention, the valve timing control device for the internal combustion engine further comprises a lock control unit provided independently of a valve timing control unit and changing an axial direction position of the lock member by controlling a hydraulic pressure of working fluid supplied to a lock working chamber that faces a pressure receiving surface of the lock member.

For instance, the lock member is slightly offset in the first direction from a radial direction center line of the first vane.

As another preferable aspect of the present invention, an axis of the lock member is positioned at a position that overlaps with the area formed by elongating the first vane to the radially inner side.

From another viewpoint, a valve timing control device for an internal combustion engine comprises: a housing rotating with one of a crankshaft and a camshaft; a vane rotor relatively rotatably provided at a radially inner side of a cylindrical-shaped cylindrical portion of the housing and disposed coaxially with the cylindrical portion, the vane rotor rotating with the other of the crankshaft and the camshaft; a plurality of shoes protruding from an inner periphery of the cylindrical portion of the housing to the radially inner side; a plurality of vanes protruding from an outer periphery of the vane rotor to a radially outer side and dividing a working chamber formed between two shoes that are adjacent to each other in a circumferential direction into a retard working chamber and an advance working chamber; a lock member provided movably in an axial direction in an accommodation hole formed at the vane rotor; and a lock hole which is provided at the housing and into which a top end portion of the lock member is fitted. And, the vane rotor is provided with a small diameter portion and a large diameter portion whose radial direction size is larger than that of the small diameter portion, the small diameter portion and the large diameter portion being arranged alternately in the circumferential direction. The large diameter portion extends in the circumferential direction so as to cover the lock hole all over a relatively rotatable range of the vane rotor with respect to the housing. The plurality of vanes include a first vane that protrudes from an outer periphery of the large diameter portion to the radially outer side and a second vane that is adjacent to the first vane in the circumferential direction and protrudes from an outer periphery of the small diameter portion to the radially outer side. And, a part of the small diameter portion remains between the large diameter portion and the second vane.

The invention claimed is:

1. A valve timing control device for an internal combustion engine comprising:

a housing having a cylindrical portion that has a cylindrical shape, a first side portion that closes an axial direction one end side of the cylindrical portion and a second side portion that closes an axial direction other side of the cylindrical portion and rotating with a crankshaft;

a vane rotor relatively rotatably disposed at a radially inner side of the cylindrical portion of the housing and rotating with a camshaft;

a plurality of shoes protruding from an inner periphery of the cylindrical portion of the housing to the radially inner side;

a plurality of vanes protruding from an outer periphery of the vane rotor to a radially outer side and dividing a working chamber formed between two shoes that are adjacent to each other in a circumferential direction into a retard working chamber and an advance working chamber;

a lock member provided movably in an axial direction in an accommodation hole formed at the vane rotor; and a lock hole opening in the axial direction at the first side portion of the housing and restraining a relative rotation position of the vane rotor to the housing by a top end portion of the lock member being fitted into the lock hole, and wherein the vane rotor has a small diameter portion and a large diameter portion whose radial direction size is larger than that of the small diameter portion, the large diameter portion extends in the circumferential direction so as to cover the lock hole all over a relatively rotatable range of the vane rotor with respect to the housing, the plurality of vanes include a first vane that protrudes from an outer periphery of the large diameter portion to the radially outer side, and at least a part of the accommodation hole is provided at the large diameter portion and located at a position that overlaps with an area formed by elongating the first vane to the radially inner side, viewed from an axial direction of the vane rotor.

2. The valve timing control device for the internal combustion engine as claimed in claim 1, wherein:

when defining a direction where a movable range in which the vane rotor can rotate relative to the housing from a lock position in the circumferential direction is smaller as a first direction, and defining a direction opposite to the first direction as a second direction, the large diameter portion includes a first large diameter portion that extends in the first direction from a position of the first vane and a second large diameter portion that extends in the second direction from the position of the first vane, and a length in the circumferential direction of the first large diameter portion is set to be longer than that of the second large diameter portion.

3. The valve timing control device for the internal combustion engine as claimed in claim 2, wherein:

the plurality of shoes include a first shoe whose tip end makes sliding contact with an outer periphery of the first large diameter portion.

4. The valve timing control device for the internal combustion engine as claimed in claim 3, wherein:

the plurality of vanes include a second vane that is adjacent to the first vane in the circumferential direction, the second vane protrudes from an outer periphery of the small diameter portion to the radially outer side, the advance working chamber is formed between the first shoe and the first vane, and the retard working chamber is formed between the first shoe and the second vane.

5. The valve timing control device for the internal combustion engine as claimed in claim 4, wherein:

a part of the small diameter portion remains between the second vane and the large diameter portion.

6. The valve timing control device for the internal combustion engine as claimed in claim 5, wherein:

the first vane is provided at two positions which are opposite sides of an axis of the vane rotor, and the second vane is provided at two positions which are opposite sides of the axis of the vane rotor.

7. The valve timing control device for the internal combustion engine as claimed in claim 3, wherein:

the plurality of shoes include a second shoe which is adjacent to the first shoe in the circumferential direction and whose tip end makes sliding contact with the small diameter portion.

8. The valve timing control device for the internal combustion engine as claimed in claim 3, wherein:

when the vane rotor rotates relative to the housing the most in the first direction, a circumferential direction side surface of the first vane contacts a circumferential direction side surface of the first shoe.

9. The valve timing control device for the internal combustion engine as claimed in claim 7, wherein:

when the vane rotor rotates relative to the housing the most in the second direction, a circumferential direction side surface of the second large diameter portion contacts a circumferential direction side surface of the second shoe.

10. The valve timing control device for the internal combustion engine as claimed in claim 1, further comprising:

a lock control unit provided independently of a valve timing control unit and changing an axial direction position of the lock member by controlling a hydraulic pressure of working fluid supplied to a lock working chamber that faces a pressure receiving surface of the lock member.

11. The valve timing control device for the internal combustion engine as claimed in claim 2, wherein:

the lock member is slightly offset in the first direction from a radial direction center line of the first vane.

12. The valve timing control device for the internal combustion engine as claimed in claim 1, wherein:

an axis of the lock member is positioned at a position that overlaps with the area formed by elongating the first vane to the radially inner side.

13. A valve timing control device for an internal combustion engine comprising:

a housing rotating with one of a crankshaft and a camshaft;

a vane rotor relatively rotatably provided at a radially inner side of a cylindrical-shaped cylindrical portion of the housing and disposed coaxially with the cylindrical portion, the vane rotor rotating with the other of the crankshaft and the camshaft;

a plurality of shoes protruding from an inner periphery of the cylindrical portion of the housing to the radially inner side;

a plurality of vanes protruding from an outer periphery of the vane rotor to a radially outer side and dividing a working chamber formed between two shoes that are adjacent to each other in a circumferential direction into a retard working chamber and an advance working chamber;

a lock member provided movably in an axial direction in an accommodation hole formed at the vane rotor; and a lock hole which is provided at the housing and into which a top end portion of the lock member is fitted, and wherein the vane rotor is provided with a small diameter portion and a large diameter portion whose radial direction size is larger than that of the small diameter portion, the small diameter portion and the large diameter portion being arranged alternately in the circumferential direction, the large diameter portion extends in the circumferential direction so as to cover the lock hole all over a relatively rotatable range of the vane rotor with respect to the housing, the plurality of vanes include a first vane that protrudes from an outer periphery of the large diameter portion to the radially outer side and a second vane that is adjacent to the first vane in the circumferential direction and protrudes from an outer periphery of the small diameter portion to the radially outer side, and a part of the small diameter portion remains between the large diameter portion and the second vane.

* * * * *